United States Patent [19]

Limque et al.

[11] 4,441,698

[45] Apr. 10, 1984

[54] FURNACE FOR THE HEAT TREATMENT OF DRILLS

[75] Inventors: Ferdinand Limque, Beatrixlaan 20, Berg en Dal, Netherlands; Cornelis H. Luiten, Nimwegen, Netherlands; Franz Bless; Reinhard Neubauer, both of Kleve, Fed. Rep. of Germany; Dietmar Lange, Rees, Fed. Rep. of Germany

[73] Assignee: Ferdinand Limque, Berg en Dal, Netherlands

[21] Appl. No.: 355,782

[22] Filed: Mar. 8, 1982

[30] Foreign Application Priority Data

Mar. 21, 1981 [DE] Fed. Rep. of Germany ..... 3111218

[51] Int. Cl.[3] ..... C21D 1/00

[52] U.S. Cl. ..... 266/249; 266/274; 266/124

[58] Field of Search ..... 266/120, 124, 133, 134, 266/125, 130, 127, 109, 105, 274, 249, 258, 260; 432/81, 77; 148/145, 149, 148, 151, 146

[56] References Cited

U.S. PATENT DOCUMENTS

| | | | |
|---|---|---|---|
| 1,310,074 | 7/1919 | Hadfield et al. | 148/149 |
| 2,321,806 | 6/1943 | Gilbertson | 266/120 |
| 2,365,183 | 12/1944 | Forsberg | 266/124 |
| 3,460,815 | 8/1969 | Corteggiano et al. | 266/124 |
| 3,615,927 | 10/1971 | Paulson | 148/149 |

FOREIGN PATENT DOCUMENTS

| | | |
|---|---|---|
| 591190 | 8/1947 | United Kingdom . |
| 1492092 | 11/1977 | United Kingdom . |
| 1494499 | 12/1977 | United Kingdom . |

*Primary Examiner*—L. Dewayne Rutledge
*Assistant Examiner*—S. Kastler
*Attorney, Agent, or Firm*—Martin A. Farber

[57] ABSTRACT

The furnace effects a partial heat-treatment of drills and similar tools having a clamping portion and a working portion and with respect to which it is important to subjecting only the working portion, to a heat treatment, particularly hardening. The physical properties of the clamping portion are, retained essentially in their original state during the heat treatment. The furnace is provided with a tool receiver that cooperates with hearth-bottom plates that are traversed by cooling fluid. The tool receiver assures that the drills or other similar tools are maintained in their clamping portion at substantially the same temperature level during the heat treatment while the working portion of the tools is freely exposed to the heating and quenching.

14 Claims, 6 Drawing Figures

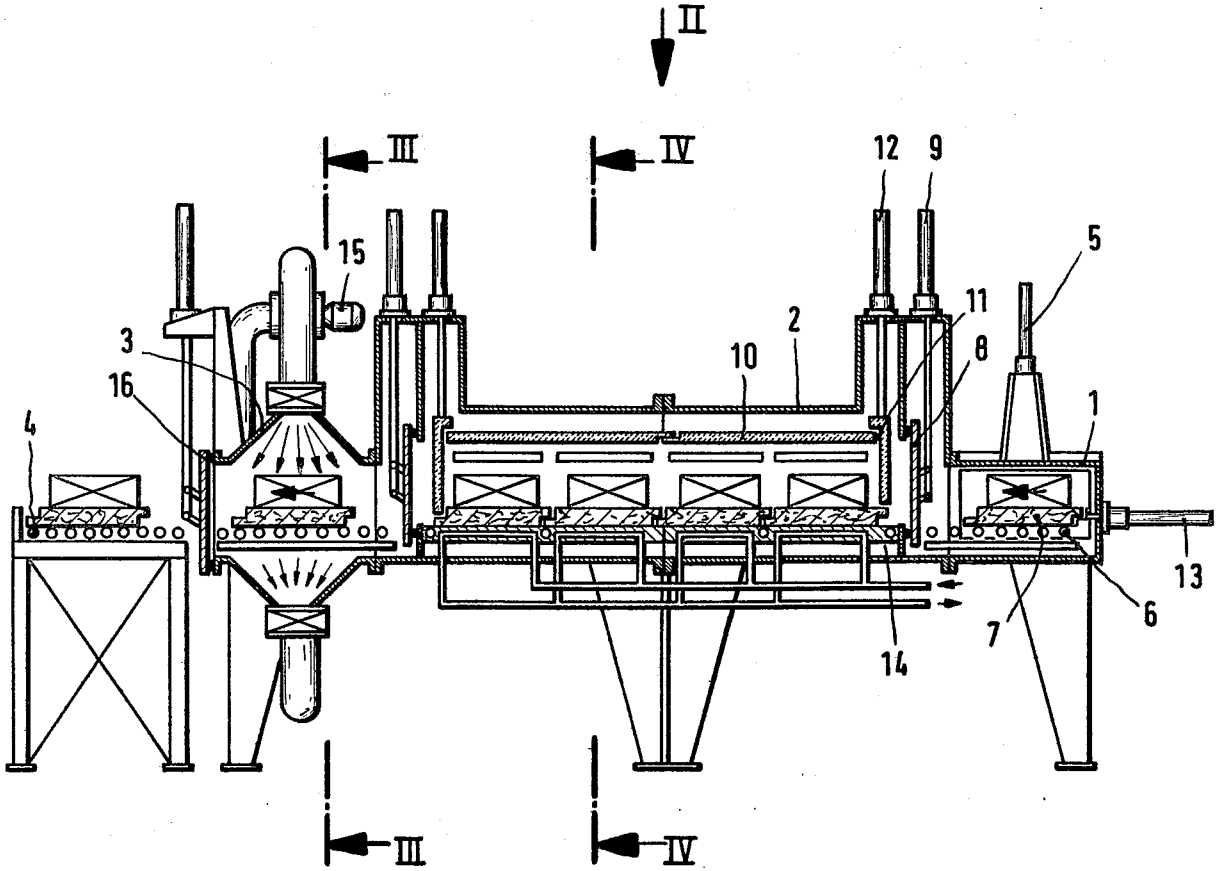
Fig. I

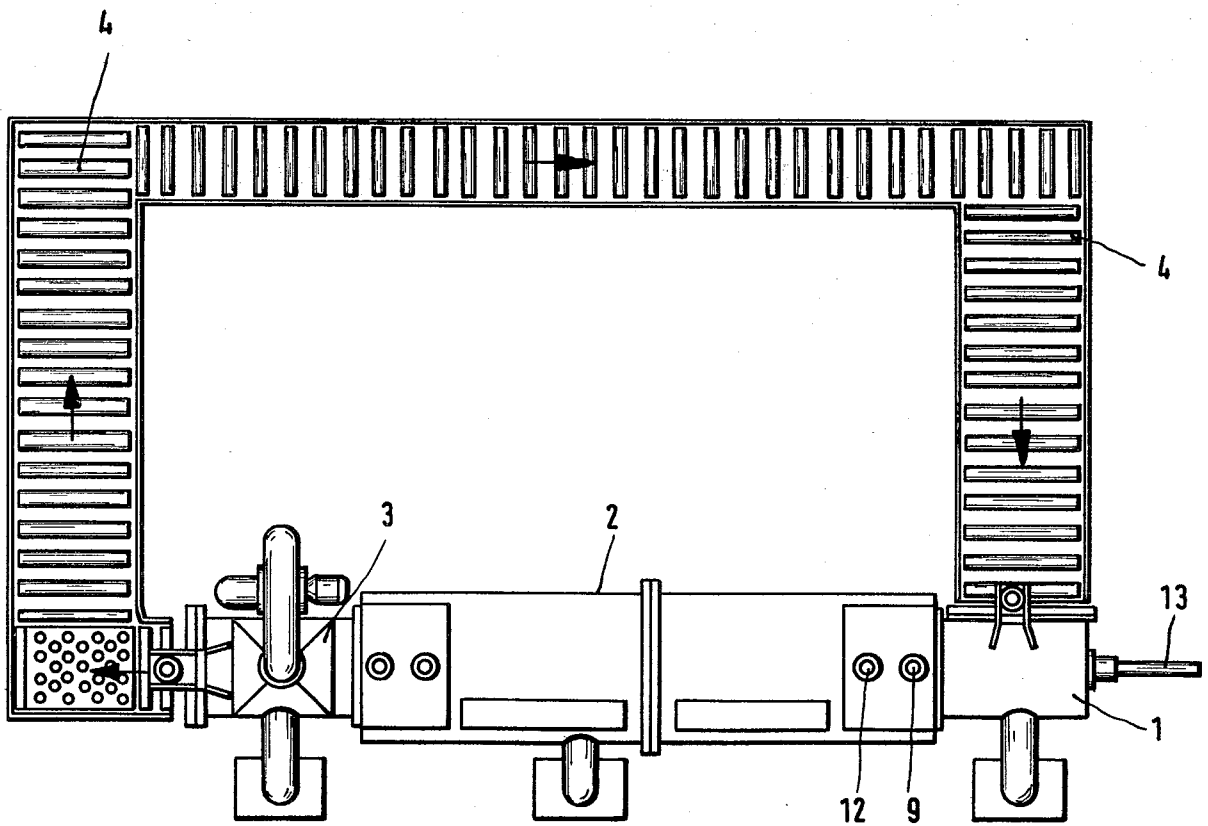
Fig. II

Fig. III
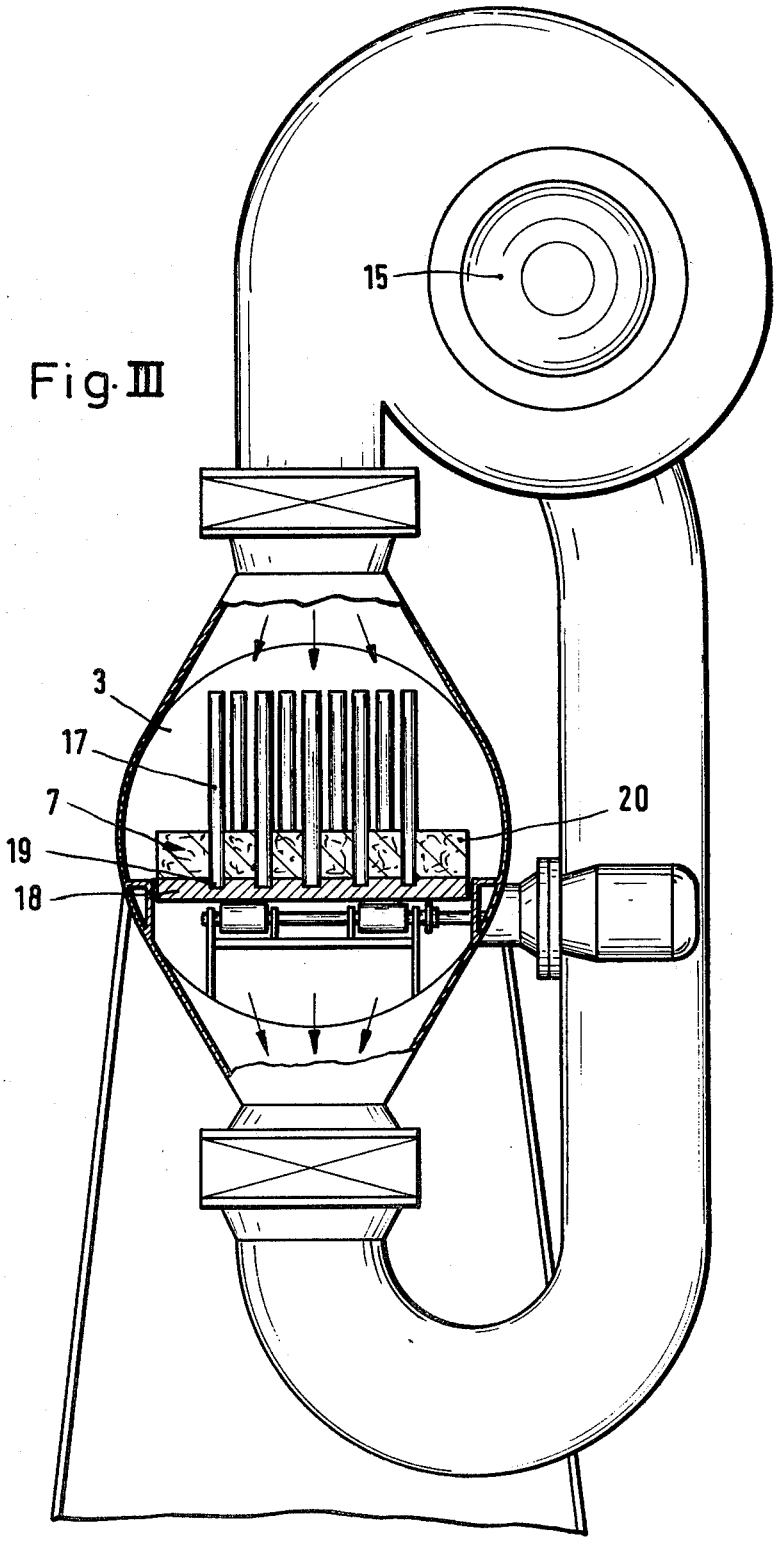

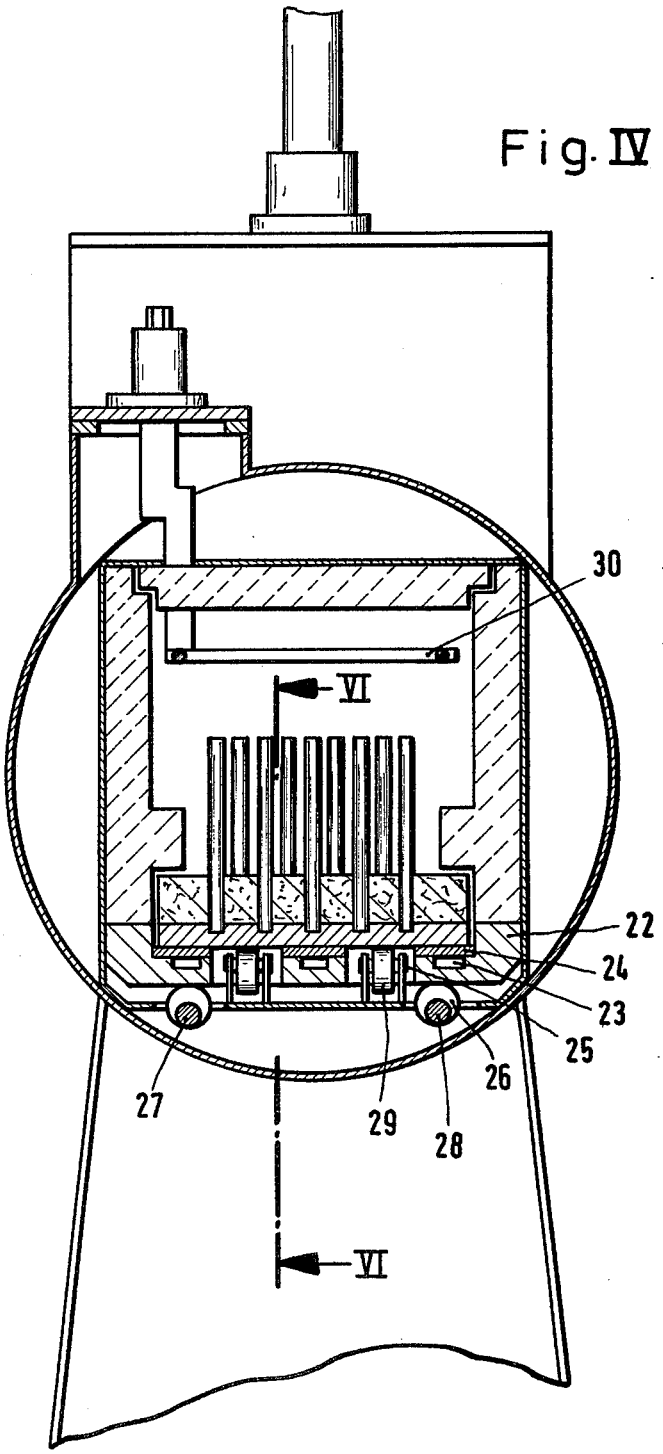
Fig. IV
30
VI
22
24
23
25
26
27
29
28
VI

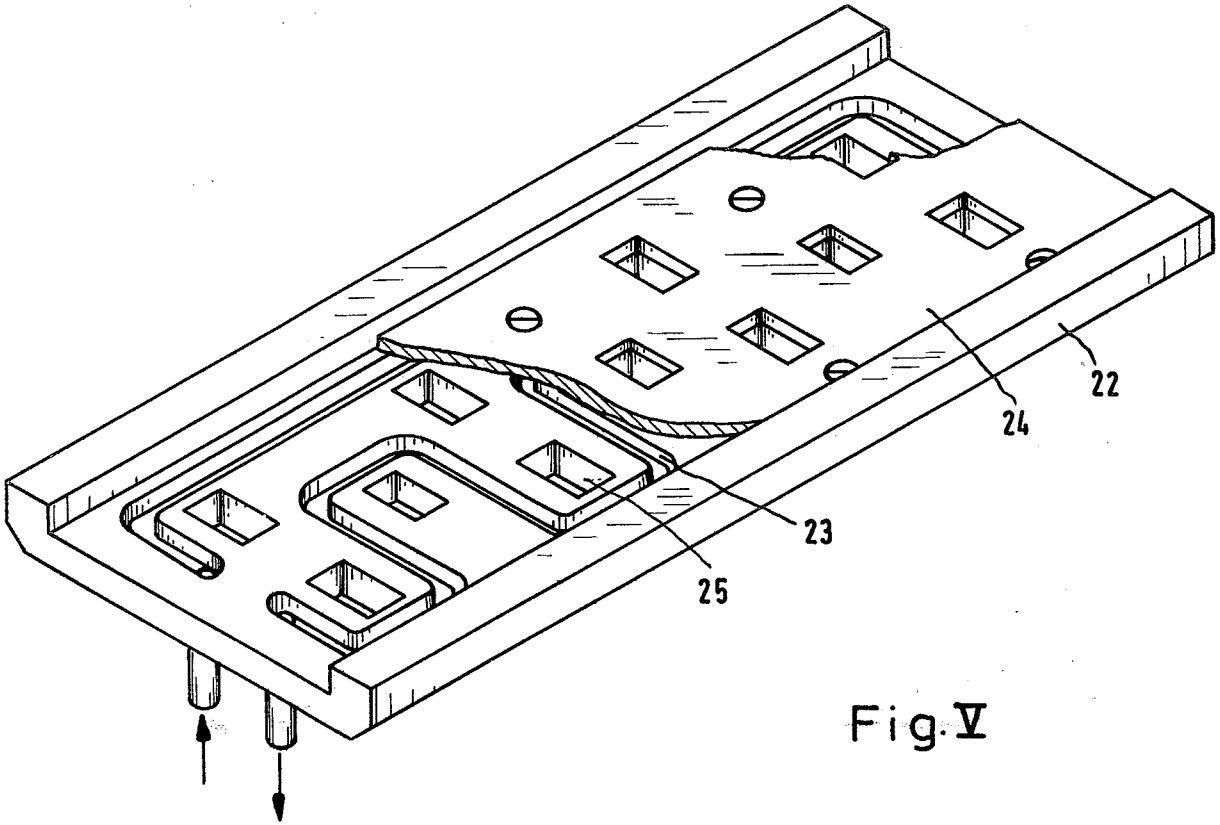
Fig. V

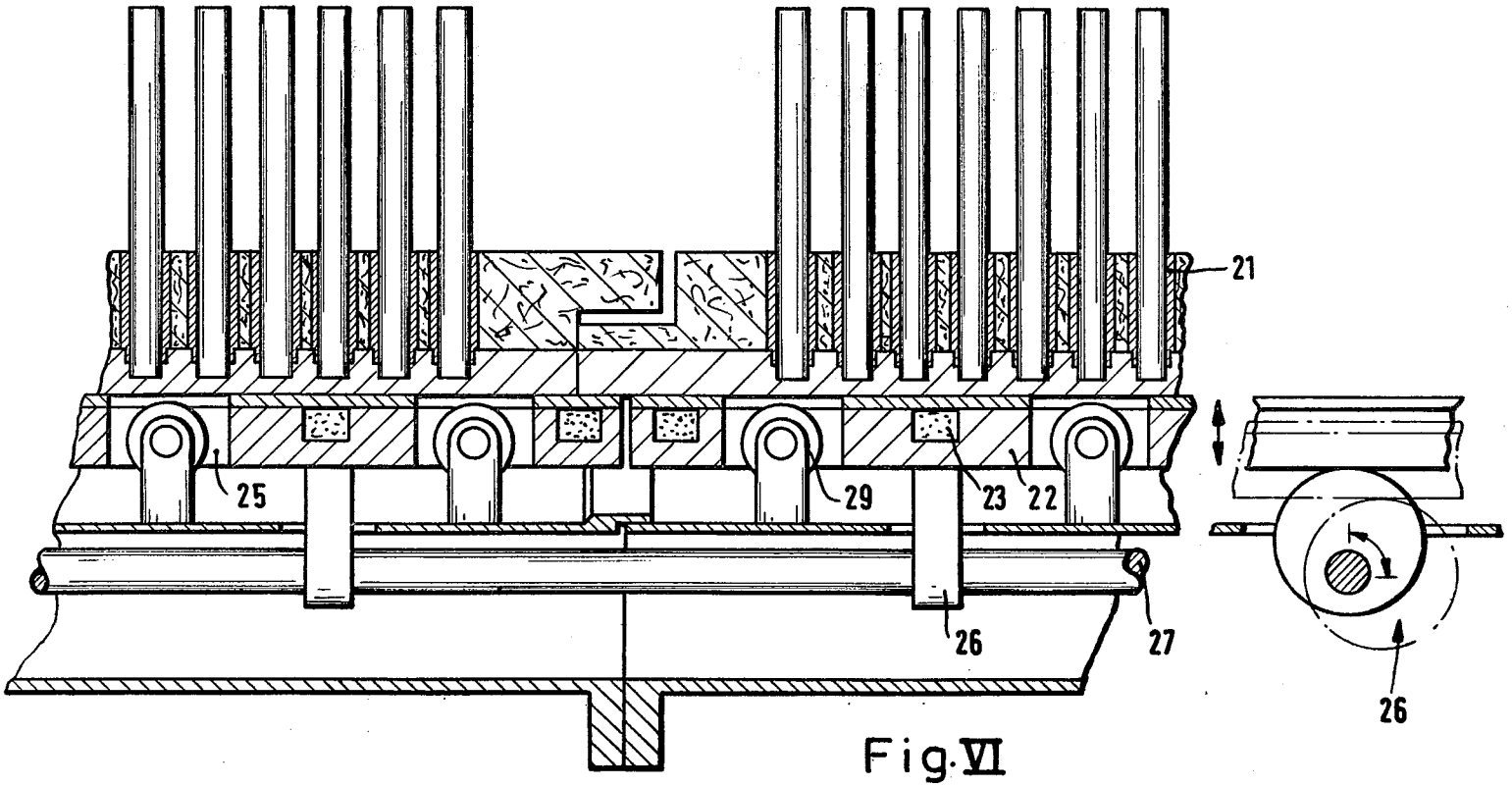
Fig. VI

FURNACE FOR THE HEAT TREATMENT OF DRILLS

The present invention relates to a furnace for the partial heat-treatment of drills and similar tools having a clamping region and a working portion, in which properties, which are changed by the heat treatment, particularly hardness, can be imparted to the working portion alone.

Drills, reamers, milling cutters, thread cutters, threading dies and similar tools consist of an insertion end for connection to the chucks of the machine tools (clamping portion) and of the helices or cutting edges (working portion) by which the machining process is carried out. The clamping portion and the working portion of the tools have different properties, and particularly a different hardnesses. In order to obtain a sufficiently long life of the tools, and particularly drills, it is necessary to subject the working portion to a specific heat treatment, while avoiding a corresponding simultaneous change in the physical properties of the clamping portion. Such a partial heat treatment of drills has been effected up to now by salt-bath hardening. For this purpose the drills are suspended individually by their clamping portion on wires or in racks, and only their working portion is extended into the salt bath. This heat treatment is disadvantageous from the standpoint of time, personnel and expense. In particular, this method cannot be used to effect vacuum hardening, for instance in a single-chamber vacuum furnace with pressure-gas quenching.

The object of the present invention is to develop a furnace for the partial heat-treatment of all sizes of drills and similar tools, including, in particular, large drills of a diameter of more than 10 mm or large batches of small drills with which high outputs can be obtained in a simple manner, with the assurance that only the working portion will be hardened and the physical properties of the clamping portion will remain unchanged.

In particular, it is desirable to partially harden large drills in an atmospheric furnace or vacuum furnace with gas quenching.

This object is achieved in accordance with the present invention in a manner whereby during the heating and quenching treatments the clamping portion of the tools is held at substantially the same temperature level in a tool receiver within the furnace and the working portion of the tools is freely exposed to the heating and the quenching treatment. The tool receiver preferably consists of a plateshaped support with a large number of recesses, preferably blind holes, in which the tools are held vertically by their clamping portion, the support being insulated and/or cooled in order to maintain its temperature level during the heat treatment. In this way, heat treatment in a gaseous furnace atmosphere or even in a vacuum furnace is accomplished and simplifies the previous partial hardening procedures in a salt bath with both metallurgically, as well as economically better results. In particular, it is thus possible in accordance with the invention to partially harden drills of all sizes and to subject large quantities of drills to the desired heat treatment within a short period of time. The hearth of the heating chamber has cooling channels formed therein to receive a flow of coolant.

Also the invention can provide means for furnishing relative movement between the hearth and the support to bring the hearth and the support into contact with each other and to space the hearth and the support from each other.

According to one suitable preferred embodiment of the invention, the hearth of the heating chamber has a cooling bottom. The cooling bottom can be formed of a plurality of cooled hearth-bottom plates within which the cooling channels traversed by the cooling fluid are formed. In order to improve the transfer of heat away from the tool receiver it is preferable that the tool receiver consist of a metal plate having good thermal conductivity. The bottom side of the plate is flat, corresponding to the bottom of the hearth, and the top side of the plate facing the heating chamber is provided with an insulating layer, for instance of ceramics or graphite wool, formed with boreholes. The boreholes can be provided with tube-shaped inserts for insulation and/or guidance. In this way, any desired control of temperature of the clamping region of the tools is possible from below, via the cooled hearth bottom, and the partial hardening of the tools can be carried out in optimum manner.

In order to improve the mounting and guidance of the tool receivers within the furnace and obtain a simple development of the cooling channels it is advantageous to develop the cooling bottom or the individual hearth-bottom plates with a U-shaped cross section and to provide the cooling channels as winding grooves in the inner surface and to close off the inner surface by a flat cover plate. This development of the cooling bottom is simpler than the existing alternative in the form of cooling boxes. In particular, for simplification of the transport of the tool receivers it is proposed, in one suitable development of the invention, that the cooling bottoms or the individual hearth-bottom plates be supported in such a manner that they can be lowered. Thus recesses are provided to receive rollers on which the transport of the tool receiver is possible with little friction when the cooling bottom is lowered.

In order, accordingly, to reduce the frictional forces upon the transport of the batches through the individual zones of the furnace when the invention is applied to a continuous pusher-type furnace, the cooled hearth-bottom plates are lowered before each cycle and the batches then transported on the rollers. After completion of the transport process (cycle), the cooled hearth-bottom plates are again moved upward and brought into surface contact with the tool receivers in order to effect the desired cooling. The cooling bottom and the individual hearth-bottom plates can be supported for this purpose on eccentric rollers.

As is already clear from this development of the furnace bottom, it is preferred that the furnace be operated as a continuous pusher-type furnace with a furnace chamber that is subdivided into a plurality of zones. Separate loading and quenching chambers are arranged in front of and behind the furnace chamber zones and, the quenching chamber being capable of is operated with a cooling blower for providing the quenching atmosphere or as a pressure quenching chamber. Advantageously the invention can also be applied to single-chamber vacuum furnaces with pressure gas quenching. The other features of the furnace, such as loading, transport mechanisms in the furnace, heating devices, cooling devices, blowers, discharge apparatus are compatible with the invention.

With the above and other objects and advantages in view, the present invention will become more clearly understood in connection with the detailed description of a preferred embodiment, when considered with the accompanying drawing, of which:

FIG. I is a cross section of a continuous pusher-type furnace, incorporating one embodiment of the present invention, FIG. II is a top view of the furnace system of FIG. I, FIG. III is a cross section through the cooling part, along the line III—III of FIG. I, FIG. IV is a cross section through the heating chamber, along the line IV—IV of FIG. I, FIG. V is a perspective view of one embodiment of a hearth-bottom plate, and FIG. VI is a partial longitudinal section along the line VI—VI of FIG. IV.

The furnace shown in the drawing is a continuous pusher-type furnace having a loading chamber 1, a furnace chamber 2 with a plurality of treatment zones, and a quenching chamber 3 from which the furnace is unloaded onto a roller table 4, the roller table, as shown in FIG. II of the drawing, going back to the loading chamber 1.

The loading chamber 1 is opened and closed by a door from the rear, as shown in FIG. I of the drawing, the door-actuation mechanism 5 of which, in the form of a compressed-air cylinder, can be noted above the furnace housing. Within the loading chamber 1 there is a roller table 6 on which a tool receiver 7 for the drills to be treated rests. This showing is purely diagrammatic since details of the tool receiver can be noted from the figures of the drawing which are described below.

Between the loading chamber 1 and the furnace chamber 2 there is a door 8 which can be actuated by means of an operating cylinder 9. The furnace chamber 2 itself is lined with an insulation 10, for instance in the form of a sleeve, and is accessible through an inner door 11 which can be actuated by an operating cylinder 12.

Within the furnace chamber 2 there are—as shown in FIG. I of the drawing—four tool receivers 7 which are transported through the furnace by means of a pusher cylinder 13 and a loading and transport device, not shown in detail, in completely automatic fashion in accordance with the cycle times of the heat treatment. In this connection they rest on a hearth of the furnace which is developed as cooling bottom 14 and are held at substantially the same temperature level by controlled cooling. The feeding and discharge of the coolant through pipelines and cooling channels in the cooling bottom 14 is shown diagrammatically in FIG. I of the drawing.

The transfer from the furnace chamber 2 to the quenching chamber 3 is again provided with an inner door and an outer door, in accordance with the doors 8 and 11 already described, so that the tool receivers 7 can be introduced stepwise into the quenching chamber 3 by the transport mechanism of the furnace and the tools can be cooled there, for instance, with inert gas. The circulation of the inert gas through the quenching chamber 3 is affected by means of a cooling blower 15.

The quenching chamber can be unloaded onto the roller table 4 through the door 16.

From FIG. III of the drawing it can be noted that the cooling blower 15, via pipe sockets, pipelines and shut-off valves with the included quenching chamber 3, makes possible a forced circulation of the quenching atmosphere which cools the regions of the inserted drills 17 to be hardened which extend out of the tool receiver 7. The tool receiver 7 consists of a plate-shaped support 18 of metal having a plurality of blind holes 19 distributed over its top, said holes being adapted to hold the drills 17 vertically—as shown in the drawing—by their clamping region. The plate-shaped support 18 consists of metal of good thermal conductivity, its bottom being flat corresponding to the hearth botom in order to provide the best possible heat transfer. Its top, on the other hand, is provided, facing the heating chamber, with an insulating layer 20 of graphite wool through which the blind holes 19 pass, tubular inserts 21—as shown in FIG. VI of the drawing—being provided for insulation and/or guidance.

Another essential feature of the furnace described is the development of the hearth of the furnace chamber 2 as cooling bottom 14.

Its precise structural development can be noted from FIGS. IV, V and VI of the drawing. In accordance therewith, the cooling bottom 14 consists of a plurality of hearth-bottom plates 22 of U-shaped cross-section which are arranged alongside of each other and in which cooling channels 23 traversed by the cooling fluid are formed. In accordance with the embodiment of a hearth-bottom plate shown in FIG. V, the cooling channels 23 are produced by cutting winding grooves in the surface of the hearth-bottom plate 22 and then closing them by a flat cover plate 24 which is applied and screwed on. For this, material of good thermal conductivity is used, particularly steel or possibly also a copper alloy. It may be pointed out here that the path of the cooling channels 23 in accordance with the embodiment of FIG. IV of the drawing differs from the path in the hearth-bottom plate 22 of FIG. V of the drawing insofar as, as seen in cross section, three cooling channels are distributed alongside of each other over the hearth-bottom plate.

Furthermore, the hearth-bottom plates 22 are provided with cutouts 25 and mounted for lifting and lowering on the eccentric rollers 26. The eccentric rollers 26 are arranged distributed on two eccentric shafts 27, 28 which extend, spaced apart from each other, through the furnace chamber 2 in its longitudinal direction, in such a manner that all hearth-bottom plates 22 forming the cooling bottom can rest well supported thereon. Rollers 29 which are mounted in place on the furnace extend through the cutouts 25 substantially into the plane of the bottom side of the tool receivers 7, the rollers upon a lowering of the hearth-bottom plates 22 taking over by eccentric displacement the supporting function for the tool receivers 7. In this way it is possible, upon the transport of the tool receivers through the individual furnace zones of the furnace chamber 2 to reduce the frictional forces in the manner that before each movement cycle the hearth-bottom plates 22 are lowered by means of the eccentric rollers 26 and the tool receivers 7 are transported alone on the then supporting rollers 29.

After the termination of such transport processes, which take place cyclically, the hearth-bottom plates 22 are raised again by means of the eccentric shafts 27, 28 and are imparted surface contact with the bottom of the tool receivers 7 so that, despite heating by means of the heating elements 30 of the furnace chamber 2, the clamping portions of the drills present in the tool receivers 7 are held at substantially the same low temperature level by the cooling bottom and the insulation.

A description of the partial hardening of the working regions of the drills which is otherwise to be effected is unnecessary since all furnace functions corresponding hereto are known. With the furnace which has been described it is for the first time possible to subject a large number of drills, and in particular also large drills of a diameter of more than 10 mm, to a partial hardening solely of the working region in a simple and rapid manner. The output through the furnace described amounts to more than 900 drills per hour. By the use of different coolants or different coolant temperatures the desired constant temperature of the clamping portion of the tools can be so controlled that optimal metallurgical influencing of the heat treatment process is obtained.

List of Reference Parts:

1 Loading chamber
2 Furnace chamber
3 Quenching chamber
4 Roller table
5 Door operation
6 Roller table
7 Tool receiver
8 Door
9 Operating cylinder
10 Insulation
11 Inner door
12 Operating cylinder
13 Pusher cylinder
14 Cooling bottom
15 Cooling blower
16 Door
17 Drill
18 Mount
19 Blind holes
20 Insulating layer
21 Insert
22 Hearth-bottom plate
23 Cooling channels
24 Cover plate
25 Cutout
26 Eccentric roller
27 Eccentric shaft
28 Eccentric shaft
29 Roller
30 Heating element

We claim:

1. In a furnace having a heating area and a quenching area for a partial heat-treatment of drills and other tools having a clamping portion and a working portion in which different properties, particularly hardness, are to be imparted by a heat treatment solely to the working portion, the improvement comprising a tool receiving member movable in said furnace from said heating area to said quenching area, said tool receiving member including means for holding a plurality of said tools such that the working portion of the tools is freely exposed to the heating and quenching as said tool receiving member moves from said heating area to said quenching area, and means for maintaining the clamping portion of said tools at substantially the same temperature level during the heating and quenching, said tool receiving member comprises a plate-like support member including a plurality of recesses of predetermined size to engage with the respective clamping portions of said tools such that the working portion of said tools projects away from said support member, means for cooling said support member to maintain said clamping portions at said temperature level during the heating, the heating area has a hearth engageable with said support member and said hearth includes said means for cooling said support member, and said hearth includes cooling channels formed therein to receive a flow of coolant.

2. The furnace according to claim 1, wherein said hearth includes a bottom plate member, said cooling channels being formed in said bottom plate member.

3. The furnace according to claim 2, wherein said support member is formed of a metal plate having predetermined thermal conductivity characteristics, the bottom of said support member being flat and substantially complementary to said hearth to furnish surface to surface contact between said hearth and said support member.

4. The furnace according to claim 3, further comprising insulating means comprising a layer of insulating material on said support member facing said heating area, said recesses continue extending through said insulating material.

5. The furnace according to claim 4, wherein tubular inserts are provided in said recesses to guide insertion of said tools in said support member.

6. The furnace according to claim 5, wherein said tubular inserts are formed of insulating material.

7. The furnace according to claim 2, wherein said bottom plate member is of flattened U-shape in cross section, and said cooling channels are formed as winding grooves in said plate member.

8. The furnace according to claim 2, wherein said hearth includes a cover plate member sized to fit against said bottom plate member to cover said cooling channels.

9. In a furnace having a heat area and a quenching area for a partial heat treatment of drills and other tools having a clamping portion and a working portion in which different properties, particularly hardness, are to be imparted by a heat treatment solely to the working portion, the improvement comprising a tool receiving member movable in said furnace from said heating area to said quenching area, said tool receiving member including means for holding a plurality of said tools such that the working portion of the tools is freely exposed to the heating and quenching as said tool receiving member moves from said heating area to said quenching area, and means for maintaining the clamping portion of said tools at substantially the same temperature level during the heating and quenching, said tool receiving member comprises a plate-like support member including a plurality of recesses of predetermined size to engage with the respective clamping portions of said tools such that the working portion of said tools projects away from said support member, means for cooling said support member to maintain said clamping portions at said temperature level during the heating, the heating area has a hearth engageable with said support member and said hearth includes said means for cooling said support member, and means for furnishing relative movement between said hearth and said support member to bring said hearth and said support member into contact with each other and to space said hearth respectively and said support member from each other.

10. The furnace according to claim 9, wherein said relative movement means comprises eccentrically mounted rollers engageable with said hearth such that rotation of said rollers against said hearth respectively elevates and lowers said hearth with respect to said support member.

11. The furnace according to claim 10, wherein said support member is supported on fixed transport rollers extending through openings provided in said hearth, said hearth making surface contact with said support member when said eccentric rollers elevate said hearth against said support member, said hearth being spaced from and out of surface contact with said support member when said eccentric rollers lower said hearth with respect to said support member such that said support member is substantially supported on said transport rollers to permit movement of said support member on said transport rollers.

12. The furnace according to claim 11, further comprising in sequence, a loading chamber, a furnace chamber, and a quenching chamber, said chambers including said transport rollers therein to permit continuous pusher type operation wherein said support member can be pushed on said rollers into said loading chamber, to said furnace chamber from said loading chamber, to said quenching chamber from said furnace chamber and outwardly of said quenching chamber.

13. The furnace according to claim 12, wherein said quenching chamber includes a cooling blower means for providing the quenching treatment.

14. The furnace according to claim 12, wherein said transport rollers are provided in sequence from the outside of said quenching chamber to the entry of said loading chamber to permit return of said support member to the loading station after the quenching treatment.

* * * * *